US006016103A

United States Patent [19]

Leavitt

[11] Patent Number: 6,016,103

[45] Date of Patent: Jan. 18, 2000

[54] SLEEP-DETECTING DRIVING GLOVES

[76] Inventor: Larry Leavitt, 329 Kenwood Ave., Delmar, N.Y. 12054

[21] Appl. No.: 09/159,737

[22] Filed: Sep. 24, 1998

Related U.S. Application Data

[60] Provisional application No. 60/060,043, Sep. 25, 1997.

[51] Int. Cl.[7] ..... G08B 23/00

[52] U.S. Cl. ..... 340/575; 340/576; 73/379.02; 73/379.09; 473/202

[58] Field of Search ..... 340/575, 576; 116/205, DIG. 44; 200/DIG. 2; 73/379.09, 379.02, 862.05, 862.581; 180/272, 271; 373/202; 473/205, 202; 2/161.2

[56] References Cited

U.S. PATENT DOCUMENTS

| | | | |
|---|---|---|---|
| 2,311,276 | 1/1943 | Wilcox | 361/230 |
| 2,575,926 | 1/1951 | Murray | 340/575 |
| 3,049,090 | 1/1962 | Bergen | 116/67 R |
| 3,585,626 | 6/1971 | Tartarini | 180/272 |
| 3,670,574 | 6/1972 | Edwards | 73/379.09 |
| 3,861,349 | 1/1975 | Conley | 116/205 |
| 4,055,905 | 11/1977 | Budrose | 434/229 |
| 4,059,830 | 11/1977 | Threadgill | 340/575 |
| 4,210,905 | 7/1980 | Coons | 340/575 |
| 4,485,375 | 11/1984 | Hershberger | 340/576 |
| 4,488,726 | 12/1984 | Murray | 473/202 |
| 4,540,979 | 9/1985 | Gerger | 340/576 |
| 5,585,785 | 12/1996 | Gwin | 340/575 |
| 5,681,993 | 10/1997 | Heitman | 73/379.02 |

*Primary Examiner*—Benjamin C. Lee
*Attorney, Agent, or Firm*—Charles J. Brown

[57] ABSTRACT

These gloves are capable of preventing motor vehicle operators from falling asleep at the wheel, a dangerous condition that happens to frequently. With strategically placed pressure sensors in the lining of the glove, a driver's grasp force on the steering wheel is monitored and an alarm system activated when pressure readings fall outside of accepted range. Communication between left glove and right gloves allows for control of the steering wheel with either hand.

3 Claims, 2 Drawing Sheets

SLEEP-DETECTING DRIVING GLOVES

As perfected from my provisional patent application No. 60/060,043 filed Sep. 25, 1997;

BACKGROUND

1. Field of invention

This invention relates to driving gloves that prevent the wearer from dozing while operating a motor vehicle.

2. Description of Prior Art

Numerous devices have been described intended to prevent drivers from falling asleep while operating an automobile. Measuring and evaluating grip pressure as applied to the steering wheel of a motor vehicle is a viable method to detect fatigue or dozing of the operator of said vehicle. Expectedly, the prior art contains several devices utilizing grip pressure as the measure of driver alertness. Unfortunately, these inventions are cumbersome, costly, and difficult to utilize making them impractical for the typical motorist. In addition, the pressure sensors are affixed in various manners to the steering wheel, making them not readily portable. In fact, as they are attached to the steering wheel, they may pose a safety hazard by interfering with normal and emergency maneuvers to maintain control of the vehicle.

In U.S. Pat. No. 4,540,979 to Gerger et al (1985) the steering-wheel based device is permanently affixed to the vehicle. While it affords protection to the user while operating said vehicle, it offers no protection should the driver operate a different vehicle not equipped with grip sensors. There are other ingenious steering-wheel based inventions for evaluating grip strength. U.S. Pat. No. 3,585,626 to Tartarini (1971), U.S. Pat. No. 4,485,375 to Hershberger (1984), and U.S. Pat. No. 2,575,926 to Murray (1949), to name a few, also involve permanently affixed devices. Said devices are also not practical due to cost and awkwardness of operation.

Various uses for pressure-sensing gloves have been described. For example, in U.S. Pat. No. 4,488,726 to Murray (1984) he describes a device that evaluates proper grip on a sports racket. Having no capacity to delay an alarm, the device would sound at every steering maneuver. Additionally, without the ability to communicate a signal from left glove to right glove, both hands would have to be on the wheel at all times. Clearly, this glove could not function for the purpose of preventing accidents due to driver fatigue. U.S. Pat. No. 3,670,574 to Edwards (1972), U.S. Pat. No. 4,055,905 to Budrose (1977), and others, describe pressure-sensing gloves. But, only a pressure-sensing glove specifically designed for detecting sleep or fatigue of the wearer as related to the operation of a motor vehicle will function properly to accomplish said objective. Just as a sleep-detecting driving glove could not hope to help with one's typing skills, as in Budrose's invention above, one would not expect his glove to protect a fatigued driver from veering off the highway.

The objects and advantages of my sleep-detecting driving glove are:

1) to provide an easy to use device that helps prevent motor vehicle accidents due to driver fatigue or dozing at the wheel.

2) to provide a portable device that can be carried easily from one vehicle to another.

3) to provide a sleep-detecting device that can be readily stored away while not in use.

4) to provide a sleep-detecting device that is comfortable to use.

5) to provide a sleep-detecting device that does not interfere with normal operation and maneuvering of an automobile.

6) to provide a sleep-detecting device that is affordable and requires no elaborate assembly.

7) to provide a sleep-detection system that is incorporated into a type of glove that is already widely used by motorists.

8) to provide a sleep-detecting device that can be customized to the users specific requirements.

DESCRIPTION OF PREFERRED EMBODIMENT

The invention consists of a pair of driving gloves outfitted with pressure sensors, a power source, a microchip for evaluating pressure readings, and an alarm system to alert the user of a potentially dangerous sleepy state. As grip pressure on steering wheel is reduced past a pre-set minimum threshold, a warning alarm is activated. Hearing this alarm will serve as a warning to the driver thereby avoiding a dangerous situation. For ease of use and a more natural operation of the vehicle, the gloves communicate remotely allowing the operator the option of using either hand for maintaining pressure on the wheel.

Figure 1:
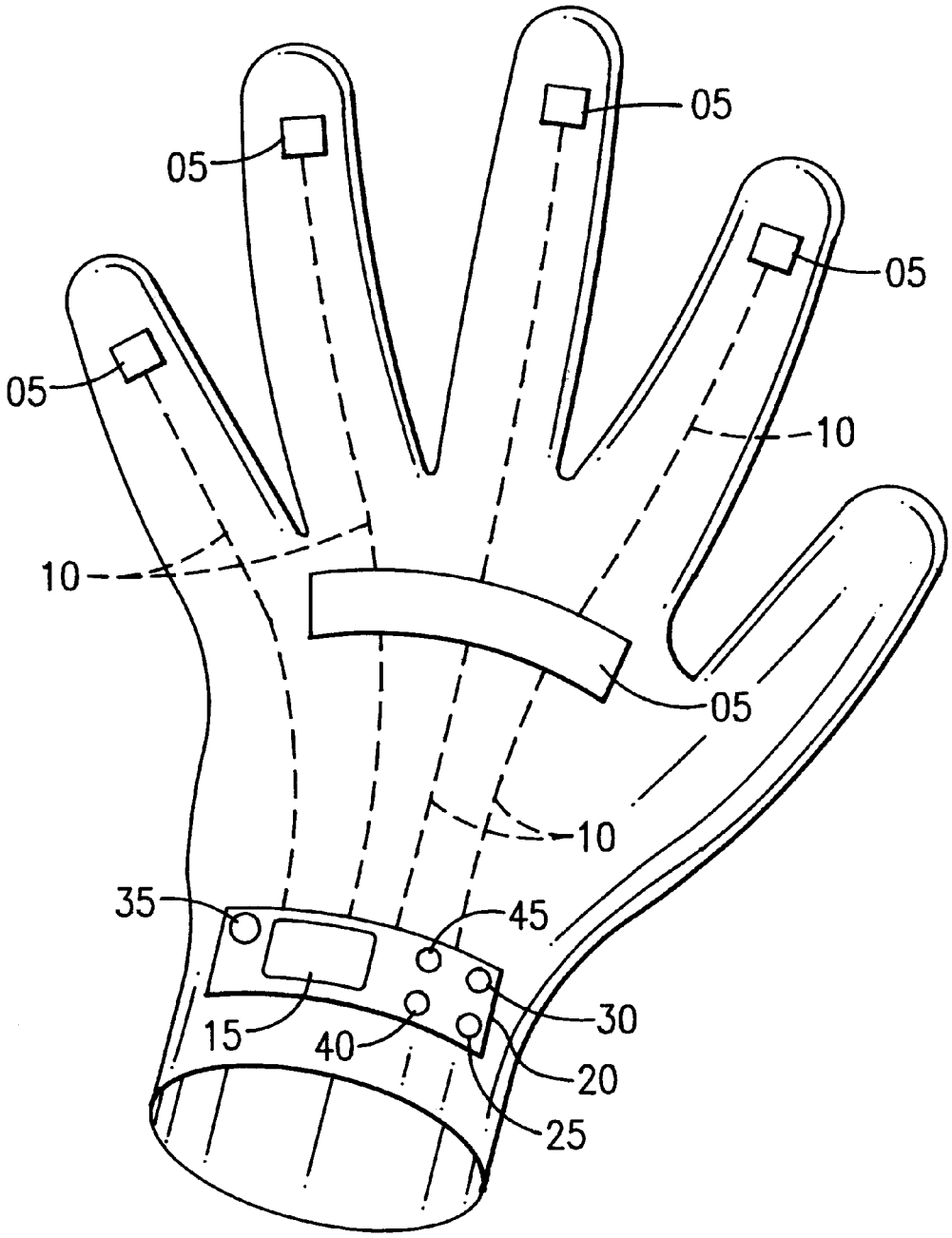
FIG. 1 shows the palmar aspect of the right-handed glove.
Figure 2:
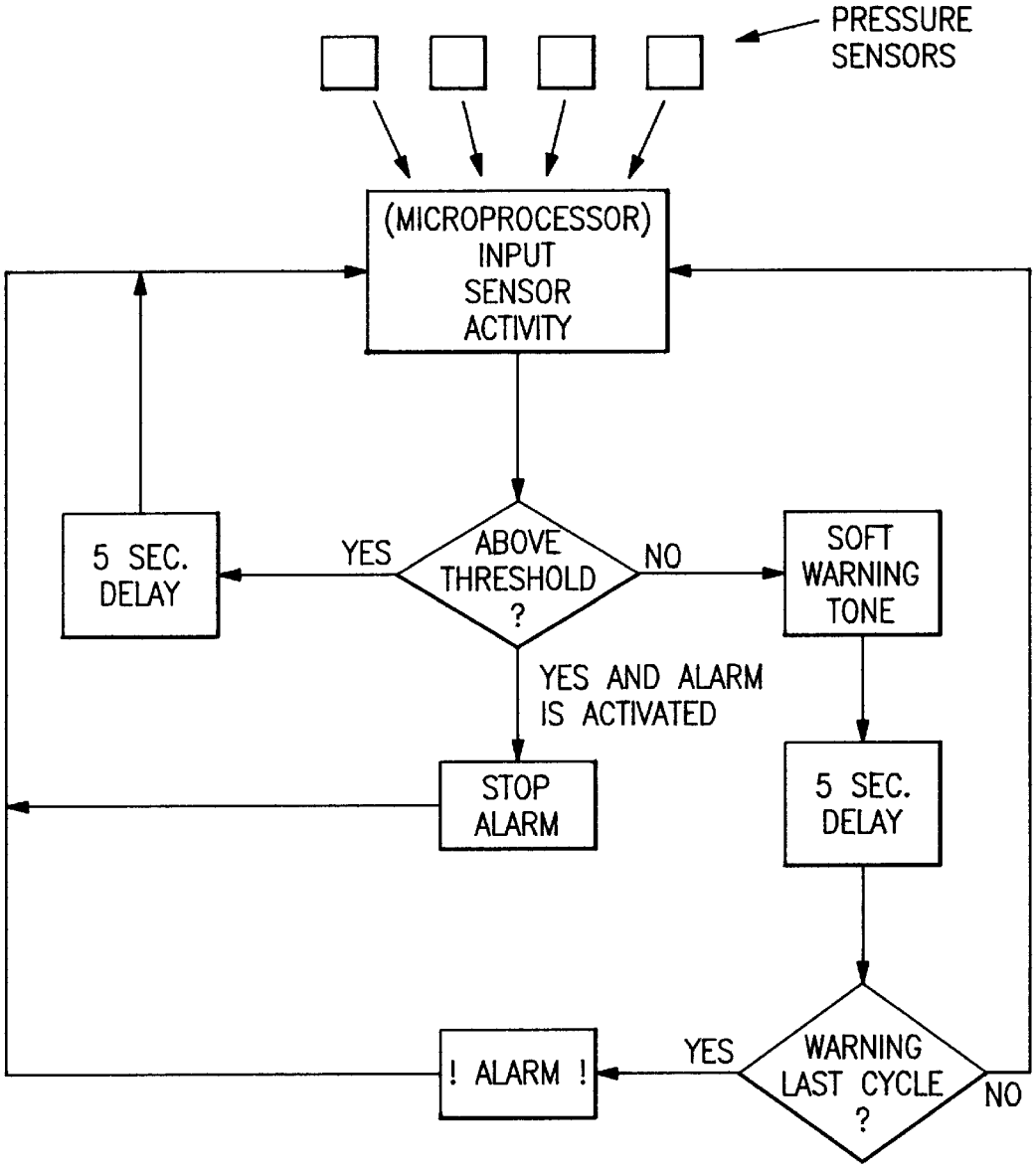
FIG. 2 is a flow chart showing the operation of the gloves of the invention.

A typical embodiment of the glove is shown in FIG. 1. The glove within its palmer surface lining utilizes standard piezoelectric or other pressure sensing elements 05 at the locations shown in FIG. 1. These sensors are connected via a conductive wire 10 to the microprocessor 15. The housing for the microprocessor also contains a battery holder 35 and a on/off indicator light 25. Also in the housing is an infrared or RF transmitter 40 and a receiver of RF and/or infrared signals 45. A speaker 30 for transmission of the audible alarm is located here, as well. An adjusting strap 20 is located in an appropriate location at the wrist.

A pair of driving gloves capable of detecting and quantifying hand grip strength of wearer, especially as it relates to driver's grip pressure on steering wheel of vehicle and incorporating an alarm system to alert said driver of reduced or absent grip on steering wheel. As a driver becomes fatigued or begins to doze, as evidenced by a reduction in strength of grip on wheel, the glove's alarm is automatically activated. Thus, a potentially dangerous situation is identified and reversed.

The preferred embodiment has 1) two driving gloves (right and left) each fitted with pressure sensors or other means to quantify force of driver's grasp of steering wheel. 2) Each glove would contain approximately five pressure sensors strategically placed along the palmar aspect of the glove, as illustrated. Adequate pressure on the palm sensor and any one of the finger sensors would suffice as sufficient and proper grip. 3) A power supply, i.e.: a watch battery. 4) A method of communication between gloves so that adequate grip strength with either glove will cause override of alarm, thereby allowing a free hand to perform other non-steering functions. Communication could be, infrared, radio wave, or other means. 5) A baseline grip strength adjustment control to allow for variations in individual baseline strength allowing for an adjustable minimum grip strength pressure threshold value. 6) An alerting mechanism whether audible or mechanical, as in vibratory or electric shock. 7) A microprocessor with delay program to allow for variability of delay time as related to reduction of grip strength and activation of alarm, as sleep would be highly unlikely shortly after much sensor activity has occurred, thus initiating an appropriate longer delay time. The microprocessor would also be programmed with various dozing-driver versus grip strength characteristics based on studies and past experience to allow for identification of known sleepy-driver hand grip patterns. This would allow for early detection and intervention of driver fatigue. 1 (see flow chart). 8) An on/off switch with glow light indicator. 9) An audible low battery warning device.

Another embodiment provides for the gloves being physically separated from the microprocessor and alarm system, whereby, the gloves would only contain the pressure sensors and transmitter. Thus, pressure readings would be sent via RF or infrared signal to a remote microprocessor and alarm device. The latter, being located nearby and powered from the car battery via cigarette lighter or other means would allow for a lighter glove and perhaps a more sophisticated and cheaper microprocessor and alarm device. However, this is not as practical as the above preferred embodiment.

Additionally, other parameters could be incorporated into the glove to help detect driver drowsiness or sleep. Pulse oximetry, blood pressure monitoring, and/or thermosensing, could be of value to this end, as it relates to a driver's physiological response to fatigue. These additional physiologic readings would be incorporated into the sleep detecting algorithm of the microprocessor's software.

Accordingly, these gloves are capable of preventing motor vehicle operators from falling asleep at the wheel, a dangerous condition that happens to frequently. With strategically placed pressure sensors in the lining of the glove, a driver's grasp force on the steering wheel is monitored and an alarm system activated when pressure readings fall outside of accepted range. Communication between left glove and right gloves allows for control of the steering wheel with either hand. Additionally, the use of standard driving gloves enhances the driving experience. By adding sleep-detecting capabilities these gloves will also provide protection for the weary driver and make highways safer for all.

I claim:

1. A sleep-detecting system for use while driving comprising a) a hand-worn device on the left hand and a hand-worn device on the right hand, b) at least one pressure sensor on each hand-worn device for measuring grip pressure between the associated hand and a steering wheel, c) remote communication means between the hand-worn devices on the left and right hands, and d) an alarm activated when grip pressure of both hands falls below a threshold value.

2. A sleep-detecting system according to claim 1 wherein alarm delay means are included for activating the alarm only after grip pressure falls below said threshold value for a predetermined time period.

3. A grip-detecting system for use when gripping an object comprising a) a hand-worn device on the left hand and a hand-worn device on the right hand, b) at least one sensor on each hand-worn device for measuring a function determined by the grip between the associated hand and said object, c) remote communication means between the hand-worn devices on the left and right hands, and d) an alarm activated when said measured function falls below a threshold value.

* * * * *